US005331940A

United States Patent [19]

Takayama

[11] Patent Number: 5,331,940

[45] Date of Patent: Jul. 26, 1994

[54] ENGINE CONTROL WITH POSITIVE CRANKCASE VENTILATION

[75] Inventor: Kengo Takayama, Atsugi, Japan

[73] Assignee: Unisia Jecs Corporation, Ayase, Japan

[21] Appl. No.: 29,246

[22] Filed: Mar. 9, 1993

[30] Foreign Application Priority Data

Mar. 9, 1992 [JP] Japan ..... 4-050361

[51] Int. Cl.[5] ..... F02D 41/14

[52] U.S. Cl. ..... 123/679; 123/698; 123/572

[58] Field of Search ..... 123/572, 574, 672, 674, 123/679, 687, 698

[56] References Cited

U.S. PATENT DOCUMENTS

| | | | |
|---|---|---|---|
| 4,003,350 | 1/1977 | Eisele et al. | 123/679 |
| 4,640,257 | 2/1987 | Kodama et al. | 123/698 |
| 4,744,344 | 5/1988 | Morozumi | 123/679 |
| 4,825,841 | 5/1989 | Norota et al. | 123/698 X |
| 4,869,223 | 9/1989 | Shimomura et al. | 123/698 X |
| 5,228,424 | 7/1993 | Collins | 123/574 |

FOREIGN PATENT DOCUMENTS

| | | |
|---|---|---|
| 60-90944 | 5/1985 | Japan . |
| 1-111119 | 7/1989 | Japan . |

*Primary Examiner*—Willis R. Wolfe
*Attorney, Agent, or Firm*—Foley & Lardner

[57] ABSTRACT

A closed loop control for an internal combustion engine with a positive crankcase ventilation is disclosed. According to this control system, the appearance of blowby gas is detected in response to variation in feedback correction coefficient (alpha), and a product of a transient blowby gas variable (BTBL) and a time dependent factor ($B_T$) is calculated and a blowby gas recirculation coefficient (KBLRC) is modified by this product ($BTBL \times B_T$) to give a modified blowby gas recirculation coefficient (KBLRC2). This modified coefficient is used in calculating a fuel injection amount (Ti) during supply of substantial blowby gas to the combustion engine after start-up of the engine.

8 Claims, 5 Drawing Sheets

ENGINE CONTROL WITH POSITIVE CRANKCASE VENTILATION

BACKGROUND OF THE INVENTION

The present invention relates to an internal combustion engine system and more particularly to an apparatus controlling an internal combustion engine with a positive crankcase ventilation system.

An internal combustion engine with a crankcase ventilation system is known in which after the engine has started, blowby gas flows from the crankcase into the combustion chamber.

An object of the present invention is to improve a control for such an internal combustion engine with a positive crankcase ventilation such that a bad influence of the blowby gas on a closed loop control is alleviated.

SUMMARY OF THE INVENTION

According to one aspect of the invention, there is provided an internal combustion engine, comprising:

a combustion chamber;

an intake passageway for admission of intake air to said combustion chamber;

an exhaust passageway for discharge of exhaust gas resulting from combustion in said combustion chamber;

a crankcase;

a positive crankcase ventilation system for admission of blowby gas to said combustion chamber;

means for detecting concentration of a component of the exhaust gas and generating a sensor signal indicative of said detected concentration;

means for effecting a closed loop control wherein a state in which the engine operates is determined, a feedback correction coefficient is determined in response to said sensor signal, a basic amount of fuel to be admitted to said combustion chamber is determined against said determined state, a final amount of fuel to be admitted to the combustion chamber is determined after correcting said basic amount of fuel by said feedback correction coefficient in such a direction as to reduce a deviation of said sensor signal from a reference value toward zero, and a fuel injection signal indicative of said final amount of fuel is generated;

means for supplying fuel to the combustion chamber in response to said fuel injection signal; and means for determining that there has been supply of blowby gas to said combustion chamber in response to variation in said feedback correction coefficient.

According another aspect of the present invention, there is provided an apparatus for controlling an internal combustion engine with a positive crankcase ventilation system, the internal combustion engine including a combustion chamber, an air intake passageway for admission of intake air to the combustion chamber, an exhaust passageway for discharge of exhaust gas resulting from combustion in the combustion chamber, a crankcase and a positive crankcase ventilation system, the apparatus comprising:

exhaust gas sensor means for detecting concentration of a component of the exhaust gas and generating a sensor signal indicative of said detected concentration;

intake air flow rate sensor means for detecting flow rate of the intake air and generating an intake air flow rate indicative signal indicative of said detected flow rate of the intake air;

engine speed sensor means for detecting revolution speed of the engine and generating an engine speed indicative signal indicative of said detected revolution speed of the engine;

a control unit operatively coupled with said exhaust gas sensor means, intake air flow rate sensor means and engine speed sensor means, said control unit including, means for determining a basic fuel injection amount in response to said intake air flow rate indicative signal and said engine speed indicative signal and generating a basic fuel injection amount indicative signal indicative of said determined basic fuel injection amount;

a random access memory storing a first map containing a number of values in a blowby gas recirculation coefficient (KBLRC) versus varying combination of values in said engine speed indicative signal (N) and said basic fuel injection amount indicative signal ($T_P$), said random access memory storing a second map containing a number of values in a transient blowby gas variable (BTBL) versus varying combination of values in said engine speed indicative signal (N);

means for setting a feedback correction coefficient (alpha) in response to a change in a deviation of said sensor signal from a first reference value;

means for calculating an average of a first value in said feedback correction coefficient which was set immediately after the occurrence of an event where said deviation of said sensor signal was on one side of said reference value and a value in said feedback correction coefficient which was set subsequently after the occurrence of the subsequent event when said deviation of said sensor signal was on the opposite side of said reference value;

means for calculating a deviation of said calculated average from a second reference value after a predetermined stable state has been attained by the engine after the engine has been started;

means for determining whether or not said calculated deviation is greater than a first predetermined value and setting a flag (BLOWFLG) when said calculated deviation is greater than said first predetermined value;

means for determining said transient blowby gas variable (BTBL) versus said engine speed indicative signal (N) and said basic fuel injection indicative signal ($T_P$) while said flag is set;

means for calculating the product of said determined transient blowby gas variable (BTBL) and a time dependent factor ($B_T$) and generating a blowby gas dependent correction factor (BLOW) indicative of said calculated product while said flag is set;

means for determining said blowby gas recirculation coefficient (KBLRC) versus said engine speed indicative signal (N) and said basic fuel injection indicative signal ($T_P$);

means for combining said determined blowby gas recirculation coefficient (KBLRC) with said determined blowby gas dependent correction factor (BLOW) to result in a modified blowby gas recirculation coefficient (KBLRC2) while said flag is set and setting said corrected fuel injection amount as a final fuel injection amount;

means for correcting said basic fuel injection amount indicative signal with said feedback correction coefficient (alpha) and said modified blowby gas recirculation coefficient while said flag is set;

means for correcting said basic fuel injection amount indicative signal with said feedback correction coefficient (alpha) and said blowby gas recirculation coefficient while said flag is not set and setting said corrected basic fuel injection amount as said final fuel injection amount; and means for generating a fuel injection signal indicative of said final injection amount; and means for supplying fuel to the combustion chamber in response to said final fuel injection amount.

DETAILED DESCRIPTION OF THE INVENTION

Figure 1:
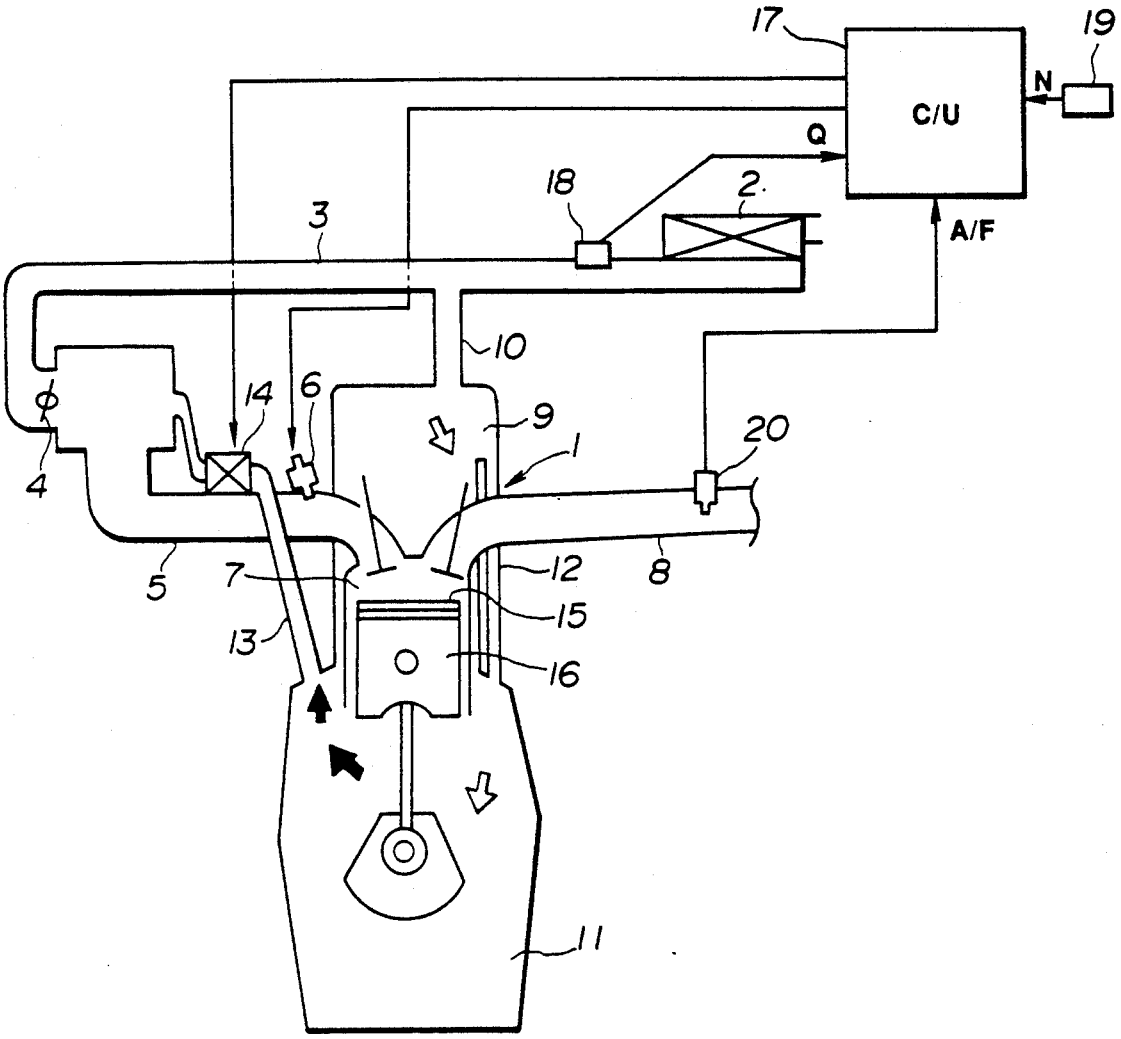
FIG. 1 is a schematic diagram showing an internal combustion engine system.

Referring to FIG. 1, there is shown an internal combustion engine 1 with an air cleaner 2. The engine 1 includes an intake duct or passageway 3 for admission of intake air via a throttle value 4 and an intake manifold 5 to a combustion chamber 7. A fuel injection valve 6 communicates with the intake manifold 5 for supplying fuel thereto in response to a fuel injection pulse, pulse duration of which is determined by a final fuel injection amount Ti determined by a control unit C/U 17. Fuel is supplied to the combustion chamber 7. An exhaust pipe or passageway 8 communicable with the combustion chamber for discharge of exhaust gas resulting from combustion in the combustion chamber 7.

The engine 1 has a positive crankcase ventilation system. This positive crankcase ventilation system includes a fresh air passage 10 having one end communicating with the intake air passageway 3 and the opposite end communicating with a rocker arm chamber 9, a transfer passage 12 having one end communicating with the rocker arm chamber 9 and the opposite end communicating with a crankcase 11, and a blowby gas passage 13 having one end communicating with the crankcase 11 and the opposite end communicating with the intake manifold 5. A positive crankcase ventilation (PCV) control valve 14 is disposed in the blowby gas passage 13. The PCV control valve opens in degrees in response to the engine operating state. Blowby gas having flown into the crankcase 11 past a clearance formed between a cylinder 15 and a piston 16 mixes with a fresh air (white arrow) from the transfer passage 12 and then flows through the blowby gas passage 13 (see black arrows) into the combustion chamber 7.

The control unit 17 is a microcomputer based control unit and includes as usual a central processor unit (CPU), a random access memory (RAM), a read only memory (ROM) and an input output interface unit (I/O) which are interconnected.

An air flow rate sensor or meter 18 is mounted to the intake duct 3 to detect a flow rate of intake air and generates an intake air flow rate indicative signal Q indicative of the detected air flow rate. A crank angle sensor 19 generates a reference crank angle signal and a unit crank angle signal. It is known that the engine revolution speed N is determined based on the reference crank angle signal. An exhaust gas sensor or an oxygen sensor 20 is mounted to the exhaust gas passageway 8 for detecting concentration of oxygen component of the exhaust gas and generating an A/F signal indicative of the detected oxygen concentration.

The control unit 17 is coupled with these sensors and meter and are fed with the output (Q) of the air flow meter 18, the output (N) of the crank angle sensor 19 and the output (A/F) of the oxygen sensor 20.

Figure 2:
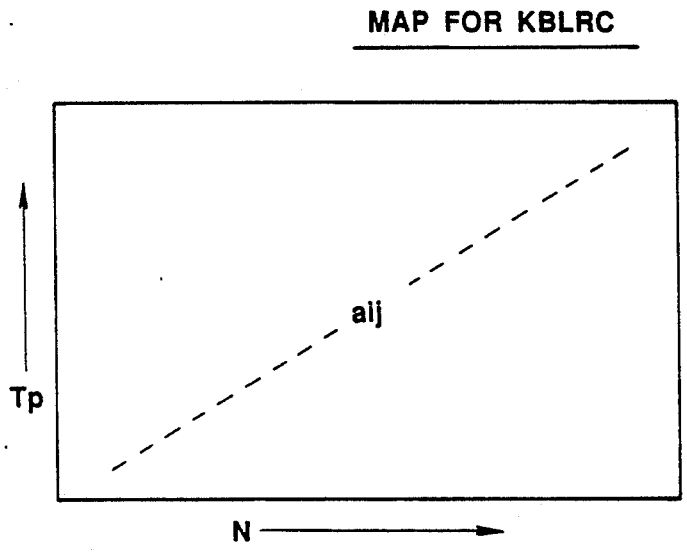
FIG. 2 is a diagram illustrating a first map for KBLRC stored in a random access memory (RAM) of the control unit in FIG. 1.
Figure 3:
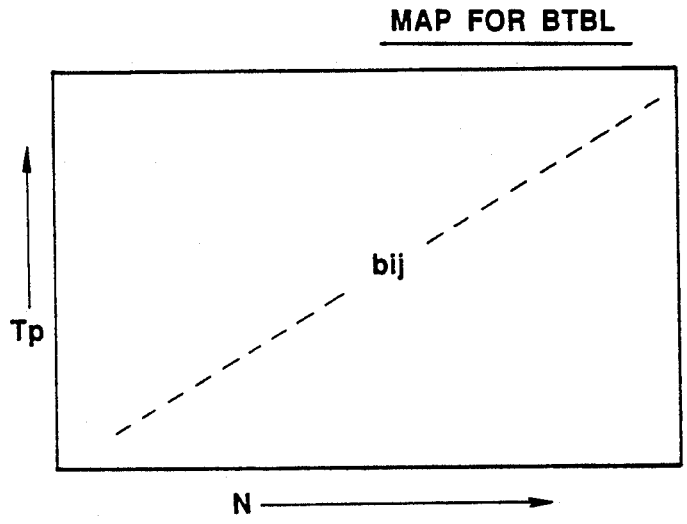
FIG. 3 is a second map for BTBL stored in the RAM of the control unit in FIG. 1.

Referring to FIGS. 2 and 3, there are shown two maps stored in the RAM of the control unit 17. The map shown in FIG. 2 contains a number of values $a_{ij}$ in a blowby gas recirculation coefficient KBLRC versus varying combination of values in engine speed N and a basic fuel injection amount Tp which is expressed by an equation $Tp=K\times q/N$ (where, K: constant). Similarly, the map shown in FIG. 3 contains a number of values $b_{ij}$ in a transient blowby gas variable BTBL versus varying combination of values in engine speed N and the basic fuel injection amount Tp. The values in these maps are subject to modification or correction. In order to protect the data in these maps upon or after turning off the engine switch, a backup electric source is provided to supply power to the RAM.

Figure 4:
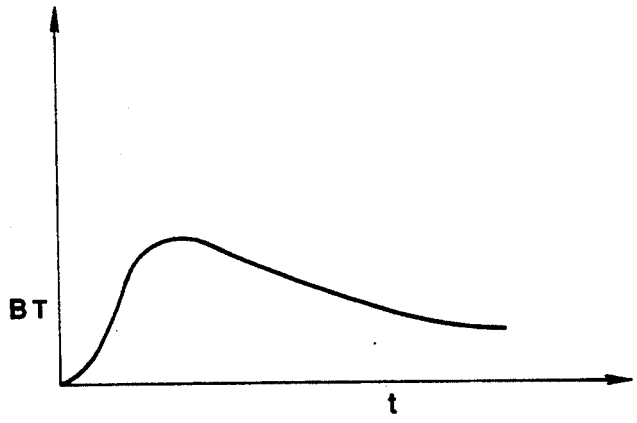
FIG. 4 is a graphical representation of a third map stored in a read only memory (ROM) of the control unit shown in FIG. 1.

Referring to FIG. 4, there is shown a map stored in the ROM of the control unit 17. The map contains a number of values in a time dependent factor $B_T$ versus lapse of time t after start-up of the engine. As will be appreciated from FIG. 4, the time dependent factor represent a decay in amount of blowby gas.

The ROM of the control unit 17 also stores a main routine for determining the final fuel injection amount Ti. The execution of this main routine is repeated and initiated by the reference crank angle signal of the crank angle sensor 16. The ROM also stores a routine for determining air fuel ratio dependent feedback correction coefficient (alpha). The execution of this routine is repeated at regular time intervals. Also stored in the ROM of the control unit 17 is a sub-routine or learning routine for updating KBLRC for rewriting the map shown in FIG. 2 and updating BTBL and rewriting the map shown in FIG. 3.

Figure 5:
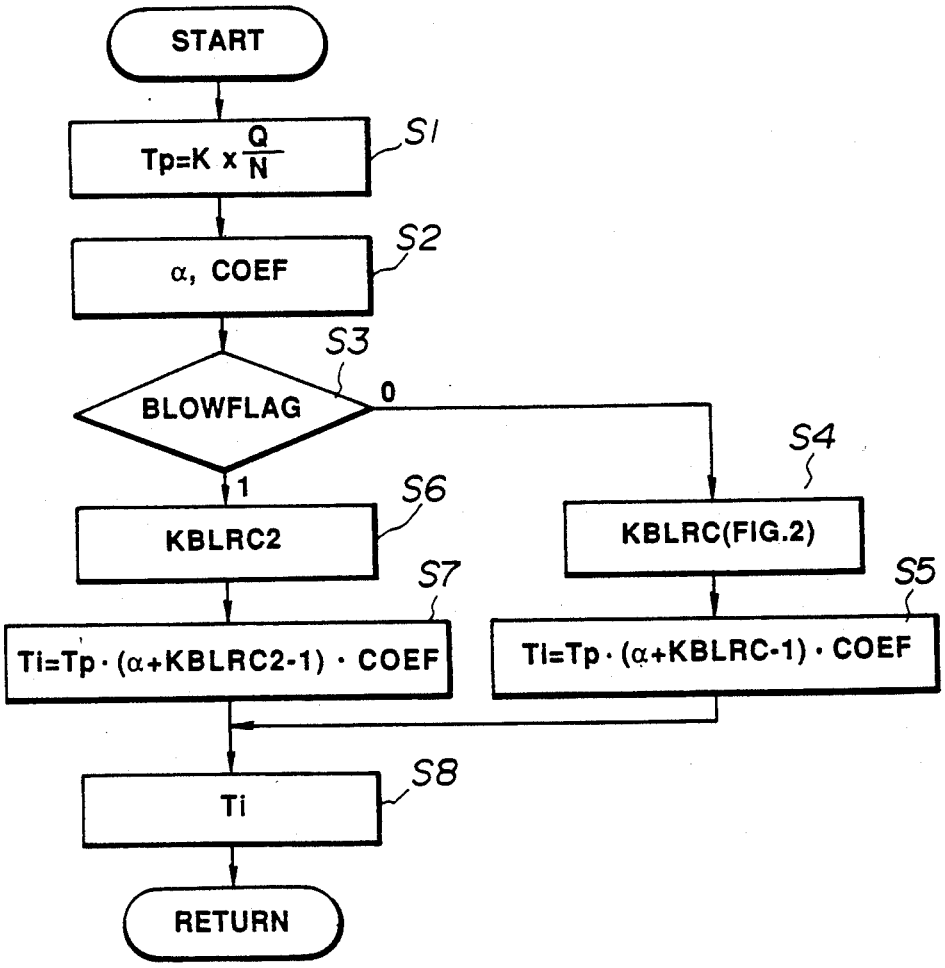
FIG. 5 is a flow diagram of a main routine for determining a final fuel injection amount (Ti), this main routine being stored in the ROM of the control unit shown in FIG. 1.

Referring to FIG. 5, although not shown, reading operations based on the output of the air flow meter 18 and on the crank angle sensor 19 to determine an air flow rate indicative signal Q and an engine revolution speed indicative signal N.

In FIG. 5, at a step S1, the basic fuel injection amount Tp is determined by calculating the following equation, $$Tp=K\times Q/N$$

where,

K: a constant,

Q: an intake air flow rate,

N: an engine revolution speed.

At a step S2, reading operations of various correction coefficients (COEF) are performed including the feedback correction coefficient α (alpha) and the other coefficients, such as, a water temperature dependent coefficient.

At a step S3, there is an interrogation whether a blowby gas flag BLOWFLAG is set or not. If the interrogation results in negative (NO), the flow proceeds to a step S4 where a table look-up operation the map shown in FIG. 2 is performed based on the engine revolution speed N and the basic fuel injection amount Tp to determine the blowby gas recirculation coefficient KBLRC.

After the step S4, the final fuel injection amount Ti is derived by calculating the following equation, $$Ti = Tp \times (\alpha + KBLRC - 1) \times COEF.$$

Figure 7:
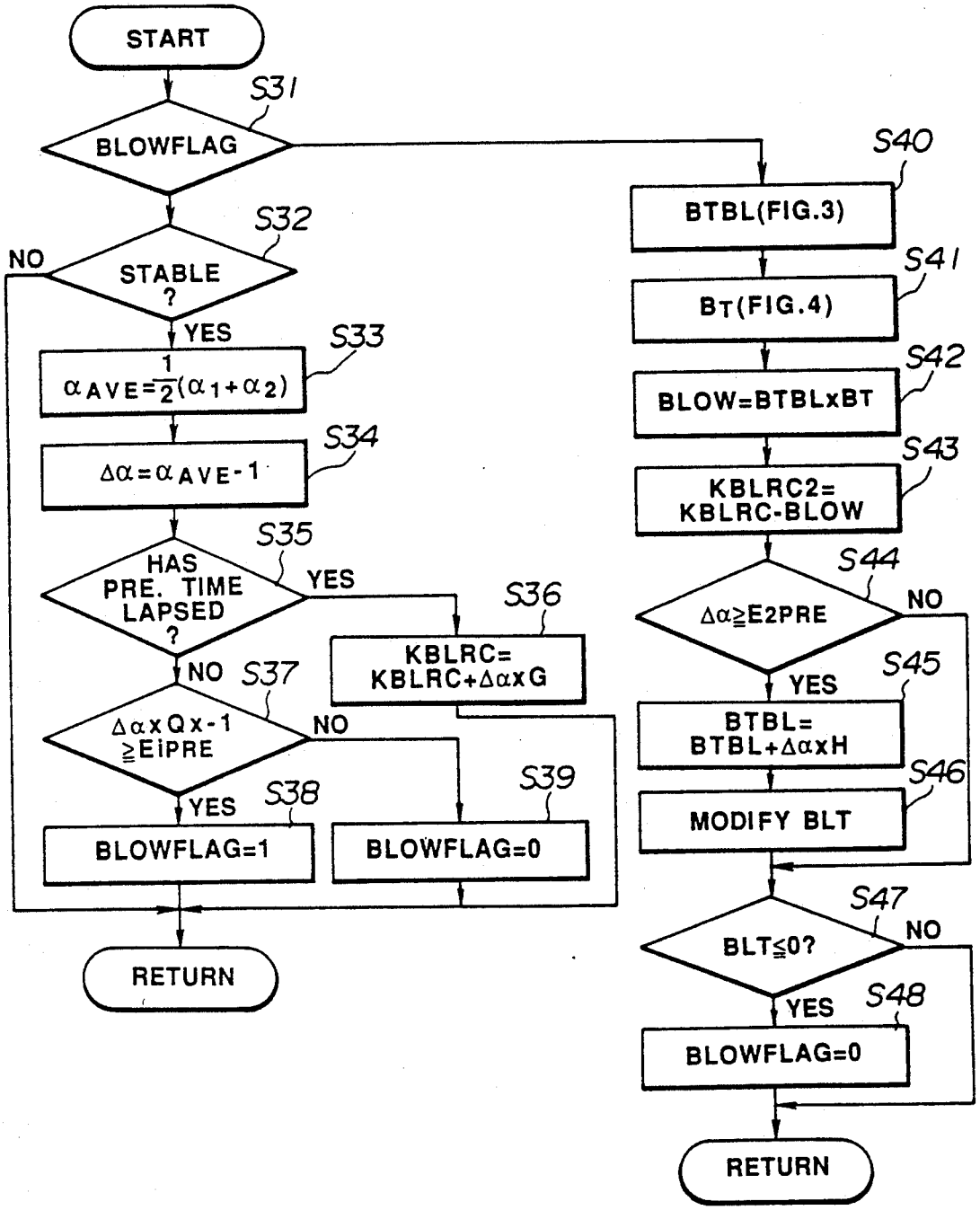
FIG. 7 is a sub-routine for rewritting the first and second maps stored in the RAM of the control unit shown in FIG. 1, this sub-routine being stored in the ROM of the control unit shown in FIG. 1.

If the result of interrogation at the step S3 results in affirmative (YES), a modified blowby gas recirculation coefficient KBLRC2, which results from modification of KBLRC in the sub-routine shown in FIG. 7 at a step S43 is fetched at a step S6. Then, the flow proceeds to a step S7 where the final fuel injection amount Ti is determined by calculating the following equation, $$Ti = Tp \times (\alpha + KBLRC2 - 1) \times COEF.$$

After the step S5 or S7, the flow proceeds to a step S8 where the final fuel injection amount Ti is moved to an output register. A fuel injection pulse with a width as much as Ti is supplied to the fuel injection valve 6 in timed with the engine revolution.

Figure 6:
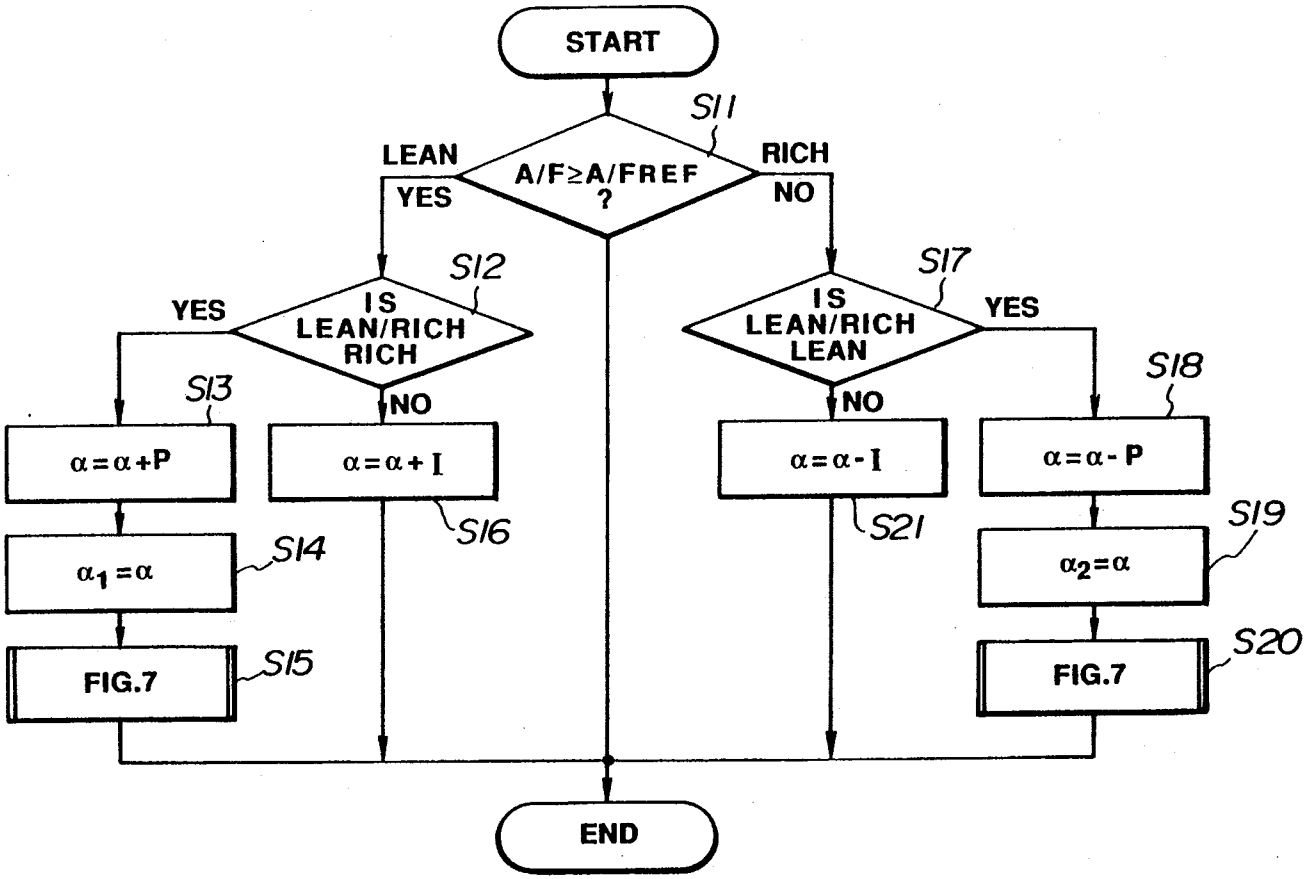
FIG. 6 is a flow diagram of a routine for setting a feedback correction coefficient (alpha), this routine being stored in the ROM of the control unit shown in FIG. 1.

At regular time intervals, the execution of the routine shown in FIG. 6 is repeated to set the feedback correction coefficient (alpha). Although not shown in FIG. 6, there is performed reading operation based on the output of the oxygen sensor 20 to determine an air fuel ratio dependent data A/F.

In FIG. 6, at a step S11, there is an interrogation whether A/F is greater than a reference value $A/F_{REF}$ or not to determine whether the air fuel ratio is on the lean side ($A/F \geqq A/F_{REF}$) or on the rich side ($A/F < A/F_{REF}$). The result of interrogation at this step S11 performed in the previous last rung of this routine is stored in a register as a lean/rich data. The lean/rich data switches to lean or rich in response to the result of interrogation at the step S11.

If the interrogation at the step 11 indicates that the air fuel ratio is on the lean side, the flow proceeds to a step S12. At the step S12, there is an interrogation whether the lean/rich data that was obtained in the previous run of the routine is in a rich state or not. If the previous lean/rich data indicates the lean state, the flow proceeds to a step S13. At the step S13, since there has occurred a shift from the rich side to the lean side, the previous value in the feedback correction coefficient α (alpha) is increased by a proportional value P. Then, the flow proceeds to a step S14 where the feedback correction coefficient α (alpha) is stored as a first data $\alpha_1$ (alpha one). After this step S14, the flow proceeds to a step S15. At the step S15, execution of a sub-routine shown in FIG. 7 is initiated.

If the air fuel ratio is on the lean side in the present run and the lean/rich data obtained in the previous run is in the lean state, the flow proceeds along the step S11 and S12 to a step S16. At the step S16, the previous value in the feedback correction coefficient α (alpha) is increased by an integral value I. The relationship is such that the proportional value P is far greater than the integral value I, i.e., $P >> I$.

If the interrogation at the step S11 indicates that the air fuel ratio is on the rich side, the flow proceeds to a step S17. At the step S17, there is an interrogation whether the lean/rich data that was obtained in the previous run of the routine is in the rich state or not. If the lean/rich data indicates the lean side, the flow proceeds to a step S18. At the step S18, since there has occurred a shift from the lean side to the rich side, the previous value in the feedback correction coefficient α (alpha) is decreased by the proportional value P. Then, the flow proceeds to a step S19 where the feedback correction coefficient α (alpha) is stored as a second data $\alpha_2$ (alpha two). After this step S19, the flow proceeds to a step S20. At the step S20, the execution of the sub-routine shown in FIG. 7 is initiated.

If the air fuel ratio is on the rich side in the present run and the lean/rich data obtained in the previous run is in the rich state, the flow proceeds along the step S11 and S17 to a step S21. At the step S21, the previous value in the feedback correction coefficient α (alpha) is decreased by the integral value I.

The sub-routine shown in FIG. 7 is explained.

In FIG. 6, at a step S31, there is an interrogation whether the flag BLOWFLAG is set or not. If this is the case (YES), the flow proceeds to a step S40 and downwards.

If the interrogation at the step S31 results in negative (NO), the flow proceeds to a step 32. At the step S32, there is another interrogation whether the engine has attained a stable state or not after start-up. The engine is said to have attained a stable state when, during the previous number of runs of the routine, the same area of map containing various values in the feedback correction coefficient has been used and in this area there a predetermined number of cyclic changes in the direction of variation of the feedback correction coefficient (alpha) have occurred.

If the interrogation at the step S32 results in negative (NO), the flow comes to an end of this sub-routine. If the interrogation at the step S32 results in affirmative (YES), the flow proceeds to a step S33.

At the step S33, the average $\alpha_{AVE}$ (alpha average) of the data $\alpha_1$ (alpha one) and $\alpha_2$ (alpha two) is given by calculating the following equation, $$\alpha_{AVE} = (\alpha_1 + \alpha_2)/2.$$

At the next step S34, a deviation Δα (delta alpha) of $\alpha_{AVE}$ (alpha average) from the reference value 1 (one) is expressed by the following equation.

$$\Delta\alpha = \alpha_{AVE} - 1.$$

At the next step S35, there is an interrogation whether a predetermined period of time has elapsed or not after the engine started. If the interrogation at the step S35 results in affirmative (YES), the flow proceeds to a step S36. At the step S36, the blowby gas recirculation coefficient KBLRC in the map shown in FIG. 2 is updated after calculating the following formula, $$KBLRC = KBLRC + \Delta\alpha \times G$$

where, G: a gain ($0 < G < 1$).

If the interrogation at the step S35 results in negative (NO), the flow proceeds to a step S37. At the step S37, a deviation of a product $\Delta\alpha \times Q_X$ (where, $Q_X$: an air flow rate dependent correction coefficient) from the reference value 1 is compared with a predetermined value $E_{1PRE}$. In other words, there is an interrogation whether $\Delta\alpha \times Q_X - 1$ is greater than or equal to $E_{1PRE}$ or not. The reason why the correction coefficient $Q_X$ is multiplied with $\Delta\alpha$ is that the dependency of the feedback correction coefficient upon the flow rate of blowby gas decreases as the flow rate of intake air Q increases.

If the interrogation at the step S37 results in affirmative (YES), the flow proceeds to a step S38. At the step S38, the flag BLOFLGA is set equal to 1. If this interrogation results in negative (NO), the flow proceeds to a step S39 where the BLOFLAG is reset to 0.

In the subsequent run of this sub-routine, if BLOWFLAG flag is set equal to 1, the flow proceeds from the step S31 to a step S40. At the step S40, there is performed a table look-up operation of the map shown in FIG. 3 based on N and Tp to find an appropriate value in BTBL. Then, at a step S41, a table look-up operation of the map shown in FIG. 4 is performed based on lapse of time (t) after the engine start-up to find an appropriate value in a time dependent factor $B_T$. Although not shown, there is a timer routine for counting a length of time after the engine start-up.

At the next step S42, the product $BTBL \times B_T$ is set as a blowby gas dependent factor BLOW. At the subsequent step S43, the modified blowby gas recirculation coeffeicient KBLRC2 is given from subtracting BLOW from KBLRC. The value KBLRC is determined by effecting a table look-up operation of the map shown in FIG. 2 prior to the calculation at the step 43.

At a step S44, there is an interrogation whether (delta alpha) is greater than or equal to a predetermined value $E_{2PRE}$ or not. If this is the case (YES), the flow proceeds to a step S45. At the step S45, BTBL is increased by a product $\Delta\alpha \times H$, where, H: a predetermined percentage. With this new value, the old value in BTBL disposed in the corresponding area in the map shown in FIG. 3 is replaced. After this step S45, the flow proceeds to a step S46 where the content of a timer BLT is increased. After incrementing of the timer BLT at the step S46, there is an interrogation whether the content of timer BLT is less than or equal to zero or not. If this is the case (YES), the flow proceeds to a step S48 where the flag BLOWFLAG is reset. If the interrogation at the step S47 results in negative (NO), the flow proceeds to an end of this sub-routine.

If the interrogation at the step S44 results in negative (NO), the flow proceeds from this step S44 to the step S47 by passing the steps S45 and S46.

What is claimed is:

1. An internal combustion engine, comprising:

a combustion chamber;

an intake passageway for admission of intake air to said combustion chamber;

an exhaust passageway for discharge of exhaust gas resulting from combustion in said combustion chamber;

a crankcase;

a positive crankcase ventilation system for admission of blowby gas to said combustion chamber;

means for detecting concentration of a component of the exhaust gas and generating a sensor signal indicative of said detected concentration;

means for effecting a closed loop control wherein a state in which the engine operates is determined, a feedback correction coefficient is determined in response to said sensor signal, a basic amount of fuel to be admitted to said combustion chamber is determined against said determined state, a final amount of fuel to be admitted to the combustion chamber is determined after correcting said basic amount of fuel by said feedback correction coefficient in such a direction as to reduce a deviation of said sensor signal from a reference value toward zero, and a fuel injection signal indicative of said final amount of fuel is generated;

means for supplying fuel to the combustion chamber in response to said fuel injection signal; and means for determining that there has been supply of blowby gas to said combustion chamber in response to variation in said feedback correction coefficient.

2. An internal combustion engine as claimed in claim 1, wherein said means for determining there has been supply of blowby gas to said combustion chamber determines that there has been supply of blowby gas to said combustion chamber when a deviation from a reference value of average of preceding values taken by said feedback coefficient as corrected by the intake air flow rate becomes greater than or equal to a predetermined value.

3. An apparatus for controlling an internal combustion engine with a positive crankcase ventilation system, the internal combustion engine including a combustion chamber, an air intake passageway for admission of intake air to the combustion chamber, an exhaust passageway for discharge of exhaust gas resulting from combustion in the combustion chamber, a crankcase and a positive crankcase ventilation system, the apparatus comprising:

exhaust gas sensor means for detecting concentration of a component of the exhaust gas and generating a sensor signal indicative of said detected concentration;

intake air flow rate sensor means for detecting flow rate of the intake air and generating an intake air flow rate indicative signal indicative of said detected flow rate of the intake air;

engine speed sensor means for detecting revolution speed of the engine and generating an engine speed indicative signal indicative of said detected revolution speed of the engine;

a control unit operatively coupled with said exhaust gas sensor means, intake air flow rate sensor means and engine speed sensor means, said control unit including, means for determining a basic fuel injection amount in response to said intake air flow rate indicative signal and said engine speed indicative signal and generating a basic fuel injection amount indicative signal indicative of said determined basic fuel injection amount;

a random access memory storing a first map containing a number of values in a blowby gas recirculation coefficient (KBLRC) versus varying combination of values in said engine speed indicative signal (N) and said basic fuel injection amount indicative signal (Tp), said random access memory storing a second map containing a number of values in a transient blowby gas variable (BTBL) versus varying combination of values in said engine speed indicative signal (N);

means for setting a feedback correction coefficient (alpha) in response to a change in a deviation of said sensor signal from a first reference value;

means for calculating an average of a first value in said feedback correction coefficient which was set immediately after the occurrence of an event where said deviation of said sensor signal was on one side of said reference value and a value in said feedback correction coefficient which was set subsequently after the occurrence of the subsequent event when said deviation of said sensor signal was on the opposite side of said reference value;

means for calculating a deviation of said calculated average from a second reference value after a predetermined stable state has been attained by the engine after the engine has been started;

means for determining whether or not said calculated deviation is greater than a first predetermined value and setting a flag (BLOWFLG) when said calculated deviation is greater than said first predetermined value;

means for determining said transient blowby gas variable (BTBL) versus said engine speed indicative signal (N) and said basic fuel injection indicative signal (Tp) while said flag is set;

means for calculating the product of said determined transient blowby gas variable (BTBL) and a time dependent factor ($B_T$) and generating a blowby gas dependent correction factor (BLOW) indicative of said calculated product while said flag is set;

means for determining said blowby gas recirculation coefficient (KBLRC) versus said engine speed indicative signal (N) and said basic fuel injection indicative signal (Tp);

means for combining said determined blowby gas recirculation coefficient (KBLRC) with said determined blowby gas dependent correction factor (BLOW) to result in a modified blowby gas recirculation coefficient (KBLRC2) while said flag is set and setting said corrected fuel injection amount as a final fuel injection amount;

means for correcting said basic fuel injection amount indicative signal with said feedback correction coefficient (alpha) and said modified blowby gas recirculation coefficient while said flag is set;

means for correcting said basic fuel injection amount indicative signal with said feedback correction coefficient (alpha) and said blowby gas recirculation coefficient while said flag is not set and setting said corrected basic fuel injection amount as said final fuel injection amount; and means for generating a fuel injection signal indicative of said final injection amount; and means for supplying fuel to the combustion chamber in response to said final fuel injection amount.

4. An apparatus as claimed in claim 3, wherein said blowby gas dependent correction factor (BLOW) is increased by said calculated deviation of said calculated average from said second reference value while said flag (BLOWFLAG) is set.

5. An apparatus as claimed in claim 3, wherein said blowby gas dependent correction factor (BLOW) is increased by said calculated deviation of said calculated average from said second reference value when said calculated deviation of said calculated average from said second reference value is greater than or equal to a second predetermined value while said flag (BLOWFLAG) is set.

6. An apparatus as claimed in claim 5, wherein said flag is reset after lapse of a period of time (BLT) after the moment when said flag was set.

7. An apparatus as claimed in claim 6, wherein said period of time (BLT) is increased when said calculated deviation of said calculated average from said second reference value is greater than or equal to said second predetermined value while said flag (BLOWFLAG) is set.

8. A method of controlling an internal combustion engine with a positive crankcase ventilation system, the internal combustion engine including a combustion chamber, an air intake passageway for admission of intake air to the combustion chamber, an exhaust passageway for discharge of exhaust gas resulting from combustion in the combustion chamber, a crankcase and a positive crankcase ventilation system, the method comprising the steps of:

detecting concentration of a component of the exhaust gas and generating a sensor signal indicative of said detected concentration;

detecting flow rate of the intake air and generating an intake air flow rate indicative signal indicative of said detected flow rate of the intake air;

detecting revolution speed of the engine and generating an engine speed indicative signal indicative of said detected revolution speed of the engine;

determining a basic fuel injection amount in response to said intake air flow rate indicative signal and said engine speed indicative signal and generating a basic fuel injection amount indicative signal indicative of said determined basic fuel injection amount;

setting a feedback correction coefficient (alpha) in response to a change in a deviation of said sensor signal from a first reference value;

calculating an average of a first value in said feedback correction coefficient which was set immediately after the occurrence of an event where said deviation of said sensor signal was on one side of said reference value and a value in said feedback correction coefficient which was set subsequently after the occurrence of the subsequent event when said deviation of said sensor signal was on the opposite side of said reference value;

calculating a deviation of said calculated average from a second reference value after a predetermined stable state has been attained by the engine after the engine has been started;

determining whether or not said calculated deviation is greater than a first predetermined value and setting a flag (BLOWFLAG) when said calculated deviation is greater than said first predetermined value;

determining said transient blowby gas variable (BTBL) versus said engine speed indicative signal (N) and said basic fuel injection indicative signal (Tp) while said flag is set;

calculating the product of said determined transient blowby gas variable (BTBL) and a time dependent factor ($B_T$) and generating a blowby gas dependent correction factor (BLOW) indicative of said calculated product while said flag is set;

determining said blowby gas recirculation coefficient (KBLRC) versus said engine speed indicative signal (N) and said basic fuel injection indicative signal (Tp);

combining said determined blowby gas recirculation coefficient (KBLRC) with said determined blowby gas dependent correction factor (BLOW) to result in a modified blowby gas recirculation coefficient (KBLRC2) while said flag is set and setting said corrected fuel injection amount as a final fuel injection amount; correcting said basic fuel injection amount indicative signal with said feedback correction coefficient (alpha) and said modified blowby gas recirculation coefficient while said flag is set;

correcting said basic fuel injection amount indicative signal with said feedback correction coefficient (alpha) and said blowby gas recirculation coefficient while said flag is not set and setting said corrected basic fuel injection amount as said final fuel injection amount;

generating a fuel injection signal indicative of said final injection amount; and supplying fuel to the combustion chamber in response to said final fuel injection amount.

* * * * *